US006690334B2

(12) United States Patent
Pintos et al.

(10) Patent No.: US 6,690,334 B2
(45) Date of Patent: Feb. 10, 2004

(54) DEVICES FOR SENDING AND RECEIVING ELECTROMAGNETIC WAVES

(75) Inventors: Jean-François Pintos, Pace (FR); Philippe Berthaud, Tonnerre (FR); Ali Louzir, Rennes (FR); Patrice Hirtzlin, Betton (FR)

(73) Assignee: Thomson Licensing S.A., Boulogne (FR)

( * ) Notice: Subject to any disclaimer, the term of this patent is extended or adjusted under 35 U.S.C. 154(b) by 0 days.

(21) Appl. No.: 10/157,572

(22) Filed: May 29, 2002

(65) Prior Publication Data

US 2002/0180653 A1 Dec. 5, 2002

(30) Foreign Application Priority Data

Jun. 1, 2001 (FR) ..... 01 07233

(51) Int. Cl.[7] ..... H01Q 3/00; H01Q 13/00
(52) U.S. Cl. ..... 343/757; 343/781 CA
(58) Field of Search ..... 343/757, 765, 343/753, 754, 755, 781 P, 781 CA

(56) References Cited

U.S. PATENT DOCUMENTS

| | | | | |
|---|---|---|---|---|
| 4,901,369 A | | 2/1990 | Momose et al. | 455/84 |
| 4,924,239 A | | 5/1990 | Ceklovsky | 343/882 |
| 6,198,452 B1 | * | 3/2001 | Beheler et al. | 343/757 |
| 6,229,500 B1 | * | 5/2001 | Caille et al. | 343/753 |

FOREIGN PATENT DOCUMENTS

| | | | |
|---|---|---|---|
| WO | WO97/15092 | 4/1997 | H01Q/1/18 |

OTHER PUBLICATIONS

French Search Report of Feb. 15, 2002.

* cited by examiner

*Primary Examiner*—Hoang V. Nguyen
(74) *Attorney, Agent, or Firm*—Joseph S. Tripoli; Kuniyuki Akiyama

(57) ABSTRACT

A device for sending and receiving electromagnetic waves comprises an antenna with a waveguide, a sending card and a receiving card.

The sending card and the receiving card each extend essentially from the waveguide, and therefore from the antenna axis, in a plane perpendicular to this axis and between them form an angle greater than 90°.

10 Claims, 2 Drawing Sheets

DEVICES FOR SENDING AND RECEIVING ELECTROMAGNETIC WAVES

FIELD OF THE INVENTION

The present invention relates to devices for sending and receiving electromagnetic waves.

BACKGROUND OF THE INVENTION

The patent application WO 99/35711, for example, describes such a device which includes a sending chip and a receiving chip, each perpendicular to a waveguide formed by an end cap and by a rod which defines a common sending and receiving direction of the device.

The sending chip comprises a power amplifier which delivers an electrical signal to the waveguide and thus generates the electromagnetic wave to be sent out. The sending chip is generally called an SSPA (Solid State Power Amplifier: semiconductor power amplifier) electronics card.

For its part, the receiving chip includes a low-noise amplifier which receives, as input, the signal output from the waveguide. The receiving chip is thus generally called an LNA (Low Noise Amplifier) electronics card.

SUMMARY OF THE INVENTION

The inventors have taken into consideration the thermal and electromagnetic problems due to the presence of these two chips or electronics cards in the device.

In order to remedy these problems, they propose a device for sending and receiving electromagnetic waves along an antenna axis comprising a sending electronics card defining a first length and a receiving electronics card defining a second length, in which the first length extends essentially from the antenna axis, in which the second length extends essentially from the antenna axis, and in which the first length and the second length define between them an angle of at least 90° in projection in a plane perpendicular to the antenna axis.

The above angle should be understood as an angle between two straight-line segments which have a common extremity (antenna axis) and which can therefore vary in a general way between 0° (segments coincident) and 180° (segments aligned but opposed with respect to the antenna axis).

According to other advantageous characteristics,

- at least one of the said electronics cards is movable in rotation with respect to a part of the device about a first axis;
- the said part of the device has a shape suitable for the said movable card to pass through during its rotation;
- the sending electronics card and the receiving electronics card are movable about the first axis and the sending electronics card and the receiving electronics card are situated respectively on either side of the first axis along the antenna axis;
- the sending card carries a power amplifier on its face opposite the receiving card;
- the face of the sending card which is turned towards the receiving card constitutes an earth plane;
- the face of the sending card which is turned towards the receiving card carries a radiator;
- the sending card extends away from the receiving card with respect to the antenna axis;

the first length and the second length form an angle of 90°.

Put another way, a device is proposed for sending and receiving electromagnetic waves including an antenna, a sending electronics card, a receiving electronics card, in which the sending electronics card possesses a first extremity opposite an antenna-connection extremity, in which the receiving electronics card possesses a second extremity opposite an antenna-connection extremity and in which the first extremity and the second extremity are separated by an angle of at least 90° with respect to the antenna in projection in a plane perpendicular to the axis of the antenna.

The antenna is, for example, connected to each of the electronics cards in the region of a primary source of the antenna, such as a waveguide. The primary source may also be of another type, for example with spirals or with printed elements.

BRIEF DESCRIPTION OF THE DRAWINGS

The description which follows will be given by reference to the attached drawings, in which.

DETAILED DESCRIPTION OF PREFERED EMBODIMENTS

Figure 1:
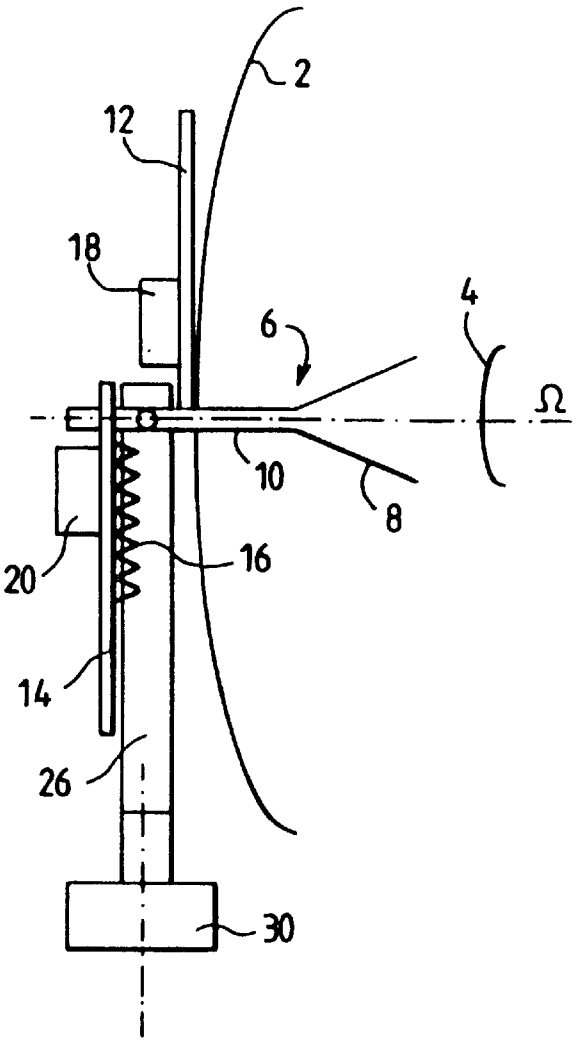
FIG. 1 represents, in sectional view, a device according to the invention.

The device represented in FIG. 1 comprises an antenna consisting of an external reflector 2 of generally parabolic shape, of an internal reflector 4 and of a waveguide 6 (which plays the role of primary source for the antenna) including a horn 8 of frustoconical shape and a tube 10 of cylindrical shape.

The antenna defines an antenna axis Ω which is the axis common to the reflectors 2, 4 and to the waveguide 6. On reception, an electromagnetic wave incident along the direction of the antenna axis Ω is concentrated onto the internal reflector 4 by the external reflector 2, then reflected by the internal reflector 4 towards the horn 8 where it propagates in the tube 10. In a symmetrical way, an electromagnetic wave induced in the tube 10 is sent out along the antenna axis Ω by the external reflector 2.

The device comprises a receiving electronics card 12 (LNA card) of generally rectangular shape, which carries a low-noise amplifier 18 (represented symbolically in FIG. 1). In an end region, in the direction of its length, the LNA card 12 is in contact with the tube 10 of the waveguide 6 in order thus to form the electrical connection between the waveguide 6 and the low-noise amplifier 18. The LNA card 12 is perpendicular to the waveguide 6 and thus to the antenna axis Ω.

The device also comprises a sending electronics card 14 (SSPA card) of generally rectangular shape which carries a power amplifier 20 (represented symbolically in FIG. 1). In an end region, in the direction of its length, the SSPA card 14 is in contact with the tube 10 of the waveguide 6 in order thus to form the electrical connection between the waveguide 6 and the power amplifier 20. The SSPA card is perpendicular to the waveguide 6 and thus to the antenna axis Ω. The face of the SSPA card 14 opposite to that which carries the power amplifier 20 constitutes the earth plane of the SSPA card 14 and carries a radiator 16 in order to facilitate the removal of the heat generated by the SSPA card 14 (up to a few tens of watts).

The assembly consisting of the antenna and the LNA 12 and SSPA 14 cards is movable in rotation on an arm 22 by means of a first motor 24. In a plane perpendicular to the antenna axis Ω, the arm 22 has the general shape of a "U", the two parallel branches 26 of which extend parallel to the length of the SSPA card 14 from a base 28. The axis of the first motor 24 extends along the length of the SSPA card 14 in the region of the respective extremities of the branches 26 which are opposite the base 28.

The first motor 24 allows adjustment of the antenna axis Ω in elevation.

The arm 22 for its part is movable in rotation by means of a second motor 30 with axis perpendicular to the antenna axis Ω and to the axis of the first motor 24. The axis of the second motor 30 is therefore parallel to the length of the SSPA card 14. The second motor 30 allows adjustment of the antenna axis Ω in azimuth.

By virtue of the motors 24, 30, the device can track a satellite in its trajectory and thus communicate with this satellite as long as it is in the field of view of the device. (This is necessary especially in the case of satellites in low orbit, or Low Earth Orbit (LEO) satellites which are mobile in the terrestrial reference system.)

As is clearly visible in FIG. 1, along the tube 10 of the waveguide 6, following the antenna axis Ω, there are found, successively:

the SSPA card 14;

the arm 22 (and thus the axis of the first motor 24);

the LNA card 12;

the external reflector 2.

The width of the SSPA card 14 is less than the distance which separates the branches 26 of the arm 22, such that, upon rotation of the first motor 24, the SSPA card 14 can pass freely between the branches 26 of the arm 22. The radiator 16 is situated on the face of the SSPA card 14 which is turned towards the arm 22 and the reflector 2.

The low-noise amplifier 18 is situated on the face of the LNA card 12 opposite the reflector 2. Furthermore, the length of the LNA card 12 extends mainly at 180° from the length of the SSPA card 14 with respect to the tube 10 of the waveguide 6 (in projection in a plane perpendicular to the antenna axis Ω). Put another way, the LNA card 12 extends away from the SSPA card 14 with respect to the waveguide 6 and therefore with respect to the antenna axis Ω.

Because of the separation of the LNA 12 and SSPA 14 cards, this configuration promotes thermal dissipation, especially in the region of the radiator 16, and reduces the temperature and thus the noise in the region of the LNA card 12. Furthermore, it makes the design of the LNA 12 and SSPA 14 cards more flexible, since it reduces the thermal or electromagnetic interactions between the two cards, interactions which usually require specific precautions.

Finally, with the LNA 12 and SSPA 14 cards being situated on either side of the arm 22 and thus of the axis of the first motor 24, the assembly mounted in rotation on the arm 22 is well balanced, which enhances the precision of alignment of the antenna axis Ω.

Figure 2:
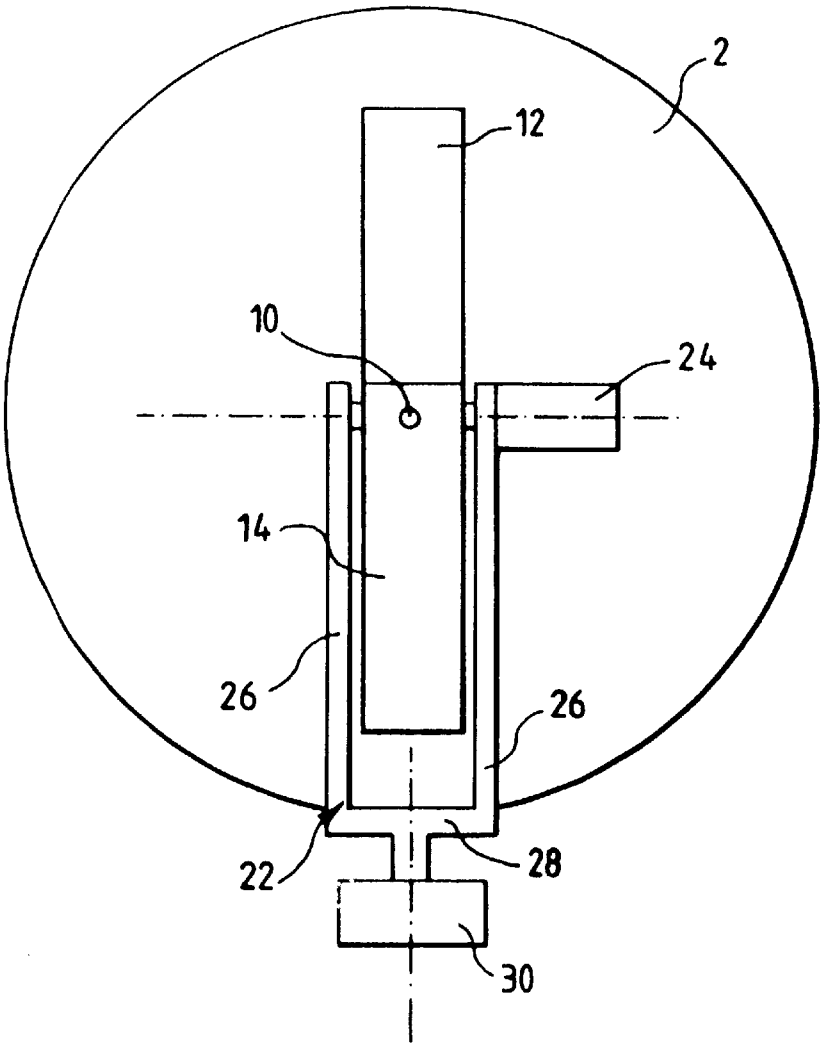
FIG. 2 represents the device of FIG. 1 seen from behind.
Figure 3:
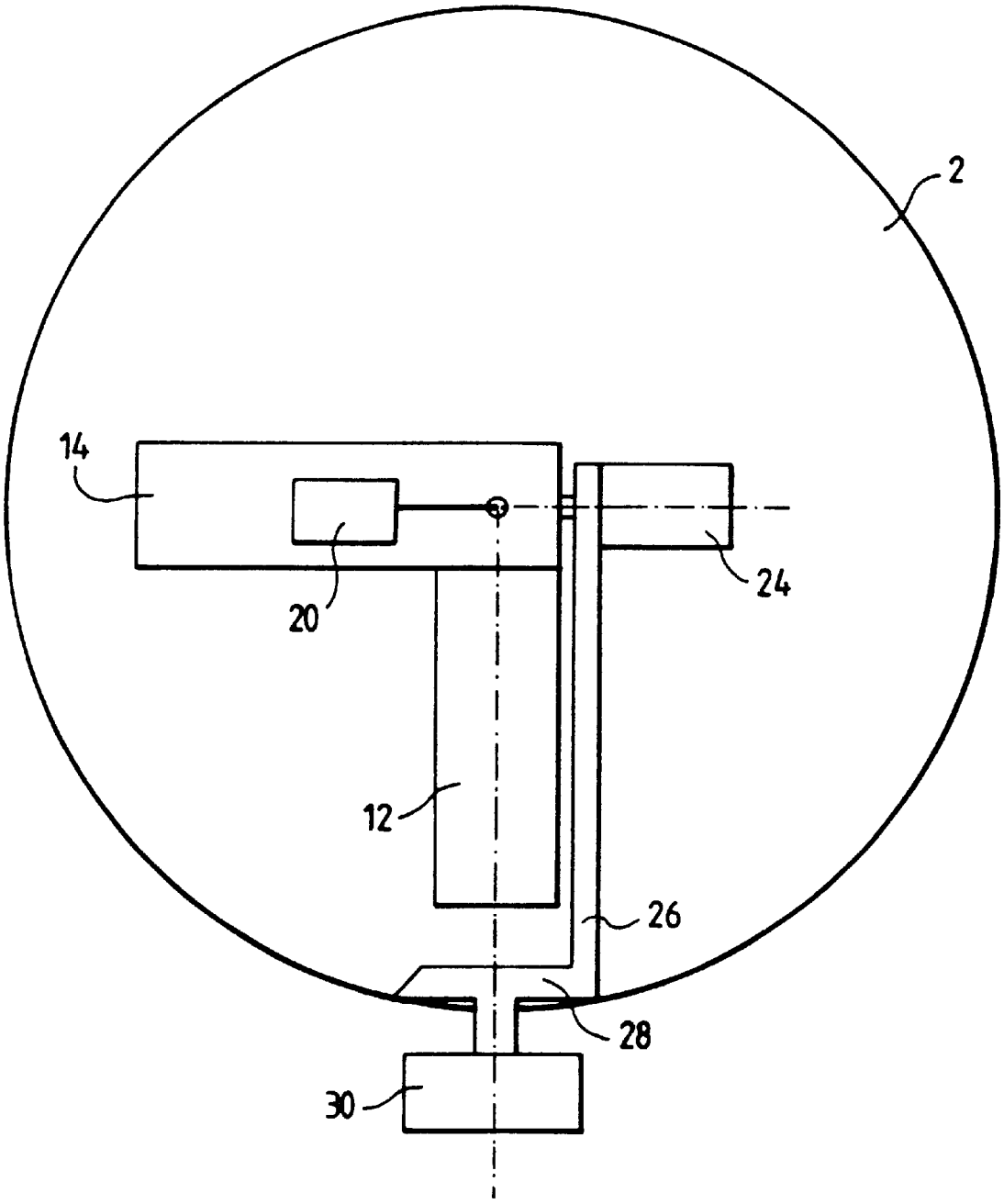
FIG. 3 represents a variant of the device of FIG. 1.

FIG. 3 represents a variant embodiment of the invention. The numerical references used in FIG. 1 and 2 are retained in FIG. 3.

The variant of FIG. 3 is distinguished from the embodiment described previously by the arrangement of the LNA 12 and SSPA 14 cards, as well as by the shape of the arm 22.

The arm 22 has the shape of an "L" consisting of a base 28 and of a branch 26. The branch 26 carries the first motor 24, the axis of which is perpendicular to the branch 26 and to the antenna axis Ω (as in the example of FIG. 1 and 2).

The length of the LNA card 12 extends parallel to the branch 26 (and therefore perpendicularly to the axis of the first motor 24 and to the antenna axis Ω) in a way which is similar to the example of FIG. 1 and 2.

In contrast, the length of the SSPA card 14 extends parallel to the axis of the first motor 24.

The LNA 12 and SSPA 14 cards are therefore each situated in a plane perpendicular to the waveguide and therefore to the antenna axis Ω as described above; however, according to the variant, the length of the LNA card 12 and the length of the SSPA card 14 form an angle of 90° in projection in a plane perpendicular to the antenna axis Ω.

Obviously, the invention is not limited to the embodiments described above. In particular, although the invention has been described in the context of a sending and receiving device with a movable antenna axis, for a low-orbit (LEO) satellite, for example, it naturally relates also to the devices with a fixed antenna axis, for example for a geostationary satellite.

What is claimed is:

1. A device for sending and receiving electromagnetic waves along an antenna axis comprising:

a sending electronics card defining a first length;

a receiving electronics card defining a second length; wherein the first length extends essentially from the antenna axis, wherein the second length extends essentially from the antenna axis and wherein the first length and the second length define between them an angle of at least 90° in projection in a plane perpendicular to the antenna axis.

2. A device for sending and receiving electromagnetic waves along an antenna axis comprising:

a sending electronics card defining a first length;

a receiving electronics card defining a second length; wherein the first length extends essentially from the antenna axis, wherein the second length extends essentially from the antenna axis and wherein the first length and the second length define between them an angle of at least 90° in projection in a plane perpendicular to the antenna axis, wherein at least one of said electronics cards is moveable in rotation with respect to a part of the device about a first axis.

3. A device according to claim 2, wherein said part of the device has a shape suitable for said moveable card to pass through during its rotation.

4. A device according to claim 2, wherein the sending electronics card and the receiving electronics card are moveable about the first axis and where the sending electronics card and the receiving electronics card are situated respectively on either side of the first axis along the antenna axis.

5. A device for sending and receiving electromagnetic waves along an antenna axis comprising:

a sending electronics card defining a first length;

a receiving electronics card defining a second length; wherein the first length extends essentially from the antenna axis, wherein the second length extends essentially from the antenna axis and wherein the first length and the second length define between them an angle of at least 90° in projection in a plane perpendicular to the antenna axis, wherein the sending card carries a power amplifier on its face opposite the receiving card.

6. A device according to claim 5, wherein the face of the sending card which is turned towards the receiving card constitutes an earth plane.

7. A device according to claim 5, wherein the face of the sending card which is turned towards the receiving card carries a radiator.

8. A device according to claim 5, wherein the sending card extends away from the receiving card with respect to the antenna axis.

9. A device for sending and receiving electromagnetic waves along an antenna axis comprising:

a sending electronics card defining a first length;

a receiving electronics card defining a second length; wherein the first length extends essentially from the antenna axis, wherein the second length extends essentially from the antenna axis and wherein the first length and the second length define between them an angle of at least 90° in projection in a plane perpendicular to the antenna axis, wherein the first length and the second length form an angle of 90°.

10. A device for sending and receiving electromagnetic waves, comprising:

an antenna with a region having a primary source;

a sending electronics card;

a receiving electronics card; wherein the sending electronics card possesses a first extremity opposite an antenna-connection extremity in said region, wherein the receiving electronics card possesses a second extremity opposite an antenna-connection extremity in said region, wherein the first extremity and the second extremity are separated by an angle of at least 90° with respect to the axis of the antenna in projection in a plane perpendicular to the axis of the antenna.

* * * * *